United States Patent [19]

Nieuwkamp et al.

[11] Patent Number: 4,558,822

[45] Date of Patent: Dec. 17, 1985

[54] BINARY ATOMIZING NOZZLE

[75] Inventors: Wolfgang Nieuwkamp, Kappishäusern, Netherlands; Sepp Mezger, Eningen, Fed. Rep. of Germany

[73] Assignee: Lechler GmbH & Co. KG, Fellbach, Fed. Rep. of Germany

[21] Appl. No.: 524,345

[22] Filed: Aug. 18, 1983

[30] Foreign Application Priority Data

Aug. 20, 1982 [DE] Fed. Rep. of Germany ..... 3230977

[51] Int. Cl.[4] ..... B05B 7/10

[52] U.S. Cl. ..... 239/403; 239/424; 239/DIG. 7

[58] Field of Search ..... 239/403, 405, 406, 424, 239/433, DIG. 7

[56] References Cited

U.S. PATENT DOCUMENTS

| | | | |
|---|---|---|---|
| 2,247,000 | 6/1941 | Popoff | 239/424 X |
| 2,560,866 | 7/1951 | Hoogendam | 239/406 X |
| 3,474,970 | 10/1969 | Simmons et al. | 239/406 X |
| 3,735,778 | 5/1973 | Garnier | 239/DIG. 7 |
| 4,335,677 | 6/1982 | Nagata et al. | 239/406 X |

*Primary Examiner*—Andres Kashnikow
*Assistant Examiner*—Daniel R. Edelbrock
*Attorney, Agent, or Firm*—Shlesinger, Arkwright, Garvey & Fado

[57] ABSTRACT

A binary atomizing nozzle includes a housing having a liquid insert and a gas insert. The liquid insert has an interior chamber and a liquid inlet and a liquid discharge communicate with the chamber. A spin insert is positioned in the chamber so that liquid flowing from the chamber is given a rotational spin and exits the liquid discharge as a hollow cone. The spin insert is threadedly engaged with the wall of the chamber so that the liquid discharge constantly wets the wall portion of the flaring discharge. The liquid insert has an outer portion spaced from the gas insert and provides an axially extending annular chamber having a gas discharge. The liquid discharge is axially spaced a preselected distance from the gas discharge so that gas exiting the gas discharge flows along the outer portion of the liquid insert according to the Coanda effect and thereby atomizes the liquid exiting the liquid discharge.

20 Claims, 1 Drawing Figure

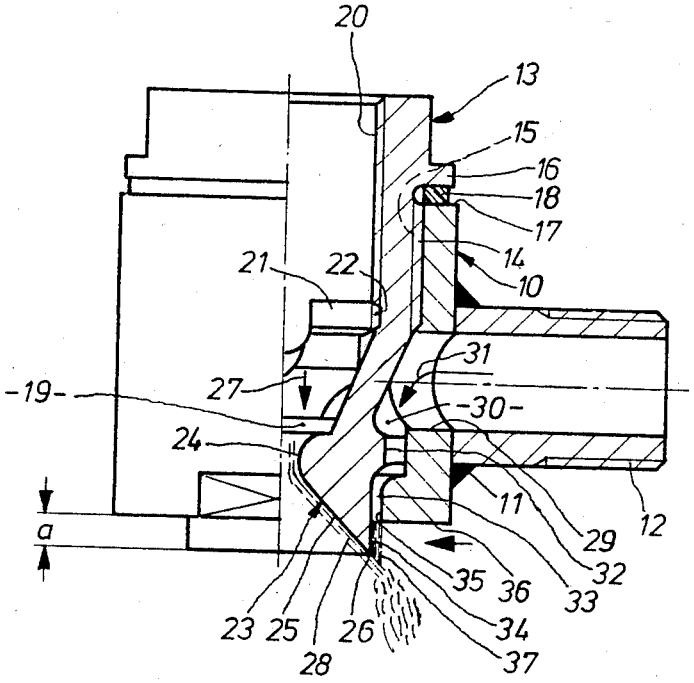
20
13
15
16
18
17
14
10
21
22
31
-19-
27
-30-
24
11
12
29
32
33
a
35
36
34
37
23
25
26
28

BINARY ATOMIZING NOZZLE

BACKGROUND OF THE INVENTION

The invention concerns a binary atomizing nozzle with a housing into which is fed a gas (for instance air) for effecting atomization and with at least one inset enclosed by the housing into which the liquid (for instance water) to be atomized is introduced, and with a nozzle-discharge formed on one hand by the housing and on the other by the inset, where the liquid flow combines with the gas flow concentrically enclosing it.

In a known binary atomizing nozzle of the above type, the inset receiving axially the liquid to be atomized forms a nozzle-discharge part where the liquid overflows along a cylindrical segment into a conical segment joining it by a sharp edge. The nozzle-discharge part of the inset is joined by a nozzle-discharge part designed conically in the same sense and formed by the housing concentrically enclosing the inset. An annular gap extends between the end of the nozzle-discharge part formed by the inset and the beginning of the nozzle-discharge part of the housing, said annular gap transmitting the gas, for instance air, to the liquid flow located concentrically within to atomize this liquid flow.

The two media, liquid and gas, impact in the above described and known nozzle in the free space due to the particular design of this embodiment and produce an energy-consuming and hence disadvantageous turbulence in the dead spaces of the nozzle discharge. The following drawbacks are further incurred: individual, large drops moving in unconstrained manner form cakings at the (conical) end surface of the inset between the liquid discharge and the air exhaust, especially when atomizing viscous media, for instance when atomizing liquids which upon evaporation leave solids or more viscous liquid residues behind. Moreover substantially large drops are generated in the outer region of the flow of the mixture, and may be a drawback in the further process.

OBJECTS AND SUMMARY OF THE INVENTION

The object of the present invention is to eliminate the cited drawbacks, that is, to strive for full wetting of the nozzle-discharge formed by the inset in order to prevent caking and furthermore to achieve such a mixing of the two media that substantially large drops are avoided in the outer region of the flow of the mixture.

This problem is solved by the invention for a binary atomizing nozzle of the initially cited kind in that the conically flaring nozzle-discharge part formed by the inset is provided with a rounding at the transition into the conical end segment and in that its discharge edge is set ahead in the direction of flow with respect to the nozzle-discharge part formed by the housing.

The rounding of the nozzle-discharge part formed by the inset forces the liquid—on account of the radial forces produced by spin—to flow directly along the conical wall surface of the inset. As a whole, the steps of the invention assure that the gas flow no longer impacts a free liquid jet as it does in the above described known nozzle. Rather, both media impact each other at the outer edge of the nozzle-discharge part formed by the inset. As a result a more uniform atomization, with more uniform drop diameters, is obtained.

Because, as already mentioned, the liquid flows directly along the wall of the nozzle-discharge part formed by the inset, this wall is completely wetted and accordingly neither cakings of liquid residues nor any dead space for disadvantageous turbulences can arise.

The invention is especially applicable to a binary atomizing nozzle wherein: the gas flow is guided in an annular space formed between the outer wall of the inset and the inside housing wall, the nozzle-discharge part formed by the housing being located at the outer end of said annular gap. In an advantageous further development of the invention, an embodiment for such a binary atomizing nozzle is proposed, which is characterized in that the outer wall of the inset forms a cylindrical guidance surface for the gas flow and is of such an extent in the direction of flow that the gas flow is guided tightly against and along the cylindrical guidance surface.

Due to the above cited steps, the gas flow so-to-speak is made to stick to the outer cylindrical guidance surface of the inset. This phenomenon is termed the Coanda effect. The advantage of the Coanda effect in the present case is that the gas flow cannot flutter, the desired uniform drop formation being thereby also affected advantageously.

DESCRIPTION OF THE DRAWINGS

The invention is described below in closer detail in relation to an illustrative embodiment shown in the drawing and discussed in the text. The drawing shows a binary atomizing nozzle in vertical longitudinal section (the right half) and in elevation (left half).

DESCRIPTION OF THE INVENTION

The drawing shows an essentially cylindrical housing 10 with a hook-up stub 12 for a gas supply, for instance air, welded to the housing 10 at 11. An overall inset 13 is provided with an outer thread 14 screwed into a corresponding inside thread 15 of the housing 10. A flange 16 forms an axial stop with respect to the housing 10 for the inset 13. A sealing ring 18 made of soft copper or a similar material is placed between the flange 16 of the inset 13 and the upper end surface 17 of the housing 10.

As further shown by the right half of the drawing, the inset 13 is provided with a severally offset inside chamber 19 of varying diameter. An inside thread 20 is provided at the upper end of the inset 13 and permits connection to a liquid conduit (omitted). At the same time, the thread 20 is used to screw-in a spin-insert 21 which has a corresponding outer thread 22.

The inset 13 forms at its lower end a nozzle-discharge part denoted as a whole by 23. The nozzle-discharge part 23 is provided at its upper end with a rounding 24 of relatively large radius. The rounding 24 uniformly merges into a conically flaring end segment 25. Lastly, a sharp nozzle discharge edge 26 is formed at the lower end. The liquid fed at 20 to the inside chamber 19 of the inset 13 flows through it in the direction of the arrow 27, that is, in the axial direction, with a simultaneously rotating motion.

The above design of the nozzle-discharge part 23 with the rounding 24, flaring end segment 25 and edge 26 assures that, as indicated by the dashed lines 28, the liquid flows in a hollow cone along the inside wall 25 of the nozzle-discharge part 23.

The gas, for instance air, provided to atomize the liquid flow 28, arrives from the already cited lateral hook-up stub 12 into a channel 29 radially arranged in the housing 10 and from there into a variable-diameter inside chamber 30 of the housing 10. When passing from the radial channel 29 into the inside chamber 30 of the housing 10, the gas flow is deflected in the direction of the arrow 31. From the annular inside space 30 the gas flow moves through channel 32 in the inset 13 and arrives in an annular gap channel 33. The annular gap channel 33 is bounded on the inside by a cylindrical outer surface 34 of the inset 13. The outer boundary of the annular gap channel 33 is formed by a cylindrical inside wall 35 of the housing 10. On the whole, the reference numerals 33, 34 and 35 denote the nozzle-discharge part for the gas flow.

The drawing makes it plain that the nozzle-discharge edge 26 of the inset 13 determining the nozzle-discharge portion of the liquid flow 28 is advanced by an amount "a" in the direction of flow 27 with respect to the lower plane end face 36 of the housing limiting the nozzle-discharge part for the gas flow.

The cylindrical guidance surface 34 for the gas flow accordingly extends so much in the direction of flow 27, that the gas flow 37 even after leaving the annular gap channel 33, remains guided tightly against and along the guidance surface 34 of the inset 13. This phenomenon is the so-called "Coanda effect". As shown by the drawing, the gas flow 37 combines with the liquid flow 28 immediately at the nozzle-discharge edge 26 of the inset 13. As a result, uniform atomization of the liquid flow 28 is obtained at high efficiency (no energy losses due to turbulence). Because the inside surfaces 24, 25 of the nozzle discharge part 23 of the inset 13 are constantly wetted by the liquid flow 28, no caking of liquid residues can form there.

What we claim is:

1. A binary atomizing nozzle, comprising;

(a) a housing including a liquid insert and a gas insert;

(b) said liquid insert having an interior chamber with a liquid inlet and a liquid discharge communicating with said chamber;

(c) a spin insert positioned in said chamber intermediate said liquid inlet and said liquid discharge providing rotational motion to liquid flowing through said chamber so that the liquid exits said liquid discharge as generally a hollow cone;

(d) means associated with said chamber positioning said spin insert so that the liquid flows along a wall portion of said chamber to said liquid discharge and thereby constantly wets said wall portion;

(e) said liquid insert having an outer portion thereof proximate said liquid discharge and spaced from said gas insert providing a generally axially extending channel and said channel having a gas discharge;

(f) said liquid discharge axially spaced a preselected distance from said gas discharge; and, (g) said gas insert includes means supplying pressurized gas to said channel so that gas exiting said gas discharge flows along said outer portion of said liquid insert according to the Coanda effect whereby liquid exiting said liquid discharge is atomized by the gas flowing along said outer portion.

2. A nozzle as defined in claim 1, wherein:

(a) said outer portion is generally cylindrical.

3. A nozzle as defined in claim 1, wherein:

(a) said chamber is generally cylindrical; and, (b) said wall portion flares toward said liquid discharge.

4. A nozzle as defined in claim 3, wherein:

(a) said chamber has a generally radially inwardly extending portion of large radius downstream of said spin insert merging into said wall portion and assuring that the liquid flows along said wall portion.

5. A nozzle as defined in claim 1, wherein:

(a) said means supplying pressurized gas includes a hook-up stub extending from said gas insert.

6. A nozzle as defined in claim 5, wherein:

(a) said hook-up stub extends generally transverse to said channel and includes means for deflecting gas into said channel.

7. A nozzle as defined in claim 5, wherein:

(a) said spin insert disposed proximate said hook-up stub.

8. A nozzle as defined in claim 1, wherein:

(a) an outwardly extending flange extends from said liquid insert; and, (b) said flange cooperates with a portion of said insert and is positioned thereby for thereby assuring proper positioning of said liquid insert with said gas insert.

9. A nozzle as defined in claim 8, wherein:

(a) seal means disposed between said flange and said portion.

10. A nozzle as defined in claim 1, wherein:

(a) said chamber having a portion thereof tapering inwardly in the direction of flow.

11. A nozzle as defined in claim 1, wherein:

(a) said spin insert threadedly engaged with corresponding threads in said chamber for thereby securing said spin insert in said chamber.

12. A nozzle as defined in claim 1, wherein:

(a) said gas insert has a generally planar end face disposed generally transverse to the direction of flow of the gas at said gas discharge.

13. A binary atomizing nozzle, comprising:

(a) a generally cylindrical housing including a liquid insert and a gas insert;

(b) said liquid insert having a generally cylindrical chamber with a liquid inlet and an outwardly flaring liquid discharge communicating with said chamber;

(c) a spin insert positioned in said chamber intermediate said liquid inlet and liquid discharge providing rotational motion to liquid flowing through said chamber so that the liquid exits said liquid discharge as generally a hollow cone;

(d) means associated with said chamber positioning said spin insert so that the liquid flows along said flaring discharge and thereby consequently wets said flaring discharge;

(e) said liquid insert having a generally cylindrical outer portion thereof proximate said liquid discharge and spaced from said gas insert for thereby providing an annular channel;

(f) a gas discharge communicating with said channel;

(g) said flaring discharge terminating in an edge and said edge axially spaced a preselected distance from said gas discharge; and, (h) said gas insert includes means supplying pressurized gas to said channel so that gas exiting said gas discharge flows along said outer portion according to the Coanda effect whereby liquid flowing beyond said edge is atomized by the gas flowing along said outer portion.

14. A nozzle as defined in claim 13, wherein:

(a) said chamber having a portion of large radius merging into said flaring discharge for assuring that the liquid flows along said flaring discharge.

15. A nozzle as defined in claim 13, wherein:

(a) a hook-up stub extends from said gas insert and supplies the pressurized gas to said channel.

16. A nozzle as defined in claim 15, wherein:

(a) said hook-up stub extends generally transverse to the axis of said chamber; and, (b) means associated with said hook-up stub for deflecting gas into said channel.

17. A nozzle as defined in claim 13, wherein:

(a) said gas insert having a generally planar end face disposed transverse to the direction of gas flow from said gas discharge; and, (b) said end face axially spaced a preselected distance from said edge.

18. A nozzle as defined in claim 13, wherein:

(a) said spin insert secured in said chamber.

19. A nozzle as defined in claim 13, wherein:

(a) a radially outwardly extending flange extends from said liquid insert; and, (b) said flange cooperates with an end face of said gas insert and thereby axially positions said liquid insert.

20. A nozzle as defined in claim 19, wherein:

(a) seal means disposed between said end face and said flange.

* * * * *